US005233393A

United States Patent [19]

Yoshida et al.

[11] Patent Number: 5,233,393

[45] Date of Patent: Aug. 3, 1993

[54] IMAGE FORMING APPARATUS

[75] Inventors: Minoru Yoshida, Tokyo; Hiroshi Murata, Yokohama, both of Japan

[73] Assignee: Kabushiki Kaisha Toshiba, Tokyo, Japan

[21] Appl. No.: 608,385

[22] Filed: Nov. 2, 1990

[30] Foreign Application Priority Data

Nov. 30, 1989 [JP] Japan ..... 1-309138

[51] Int. Cl.[5] ..... G03G 15/14

[52] U.S. Cl. ..... 355/271; 355/273; 355/277; 430/109; 430/111; 430/126

[58] Field of Search ..... 355/271, 273, 274, 277; 430/109-111, 126, 124

[56] References Cited

U.S. PATENT DOCUMENTS

| | | | |
|---|---|---|---|
| 3,876,610 | 4/1975 | Timmerman | 430/111 X |
| 4,137,188 | 1/1979 | Uetake et al. | 430/111 |
| 4,288,517 | 9/1981 | Arimatsu et al. | 430/110 |
| 4,309,803 | 1/1982 | Blaszak | 355/271 |
| 4,345,015 | 8/1982 | Hendricksma et al. | 430/111 X |
| 4,379,630 | 4/1983 | Suzuki et al. | 355/274 |
| 4,382,673 | 5/1983 | Nakajima et al. | 355/274 |
| 4,395,485 | 7/1983 | Kashiwagi et al. | 430/109 |
| 4,647,522 | 3/1987 | Lu | 430/109 X |
| 4,816,365 | 3/1989 | Ishikawa | 430/111 |
| 4,837,101 | 6/1989 | Gruber et al. | 430/109 |
| 4,933,251 | 6/1990 | Ichimura et al. | 430/111 X |
| 4,943,506 | 7/1990 | Demizu | 430/111 X |
| 4,953,031 | 8/1990 | Katoh et al. | 355/271 X |
| 4,965,158 | 10/1990 | Gruber et al. | 430/126 X |
| 4,967,231 | 10/1990 | Hosoya et al. | 355/271 X |
| 4,977,430 | 12/1990 | Florack et al. | 355/274 |
| 4,988,143 | 3/1991 | Kumasaka et al. | 355/271 |
| 4,999,677 | 3/1991 | Landa et al. | 355/273 |
| 5,010,370 | 4/1991 | Araya et al. | 355/274 |
| 5,059,505 | 10/1991 | Kashihara et al. | 430/110 |
| 5,066,558 | 11/1991 | Hikake et al. | 430/109 |
| 5,084,735 | 1/1992 | Rimai et al. | 355/271 |
| 5,089,856 | 2/1992 | Lauda et al. | 355/277 X |
| 5,099,286 | 3/1992 | Nishise et al. | 355/272 |

FOREIGN PATENT DOCUMENTS

| | | |
|---|---|---|
| 63-88582 | 4/1988 | Japan . |
| 64-6988 | 1/1989 | Japan . |

*Primary Examiner*—A. T. Grimley
*Assistant Examiner*—Matthew S. Smith
*Attorney, Agent, or Firm*—Foley & Lardner

[57] ABSTRACT

An apparatus for forming an image on a medium includes a photo-sensitive drum, exposing lamp for forming an electrostatic latent image on the drum, a developing unit for developing the latent image by sticking on the same a developer containing a toner having an average particle diameter of 3-10 μm, and an image-transferring roller for pressing the medium against the developed image with a predetermined pressure to thereby transfer the image onto the medium.

15 Claims, 5 Drawing Sheets

IMAGE FORMING APPARATUS

BACKGROUND OF THE INVENTION

1. Field of the Invention

This invention relates to an image forming apparatus which develops the electrostatic latent image formed on a photo-sensitive drum, with toner having a small particle size, and transfers the image onto a paper sheet by an image-transferring roller or belt.

2. Description of the Related Art

In recent years, the quality of an image formed by electrophotography, one of image forming methods for copying machines or printers, has been enhanced by, for example, using toner having a smaller particle size. Although the toner of a small particle size may easily scatter, is expensive, and requires high cleaning cost, its use has become an important technique for enhancing the quality of the image, partly because of an improvement in a technique of manufacturing finer toner particles (e.g. suspension polymerization).

In general, the toner image formed on a photo-sensitive drum is transferred onto a paper sheet by using corona transfer method, that is, by applying corona ions to the reverse side of the paper sheet.

More specifically, the periphery of the photo-sensitive drum is electrostatically charged by a charger, and then an electrostatic latent image is formed on the drum by exposure means. The latent image is developed into a toner image by a developing unit, and the toner image formed on the drum is transferred to a transferring region by rotating the drum. Sheets of paper are supplied from a paper cassette, one by one, in synchronism with the charging, exposing, and developing processes, and transferred to the transferring region by an aligning roller. In the region, corona ions are applied to the reverse side of the paper sheet by a corona charger, whereby the toner image is transferred onto the sheet. This sheet is then separated from the drum by an AC separating charger, moved to a fuser where the toner image is fixed, and discharged. The residual toner is removed from the drum by a cleaning device. Further, all static electricity on the drum is eliminated by a discharger, which is the termination of one cycle of copying procedure.

The present inventors measured the relationship between gradation and the particle diameter of toners.

FIG. 7 shows OD - ID curves indicating the relationship between the original density and image density, which were obtained when toners having average particle diameters of 5 μm, 7 μm, 9 μm, and 11 μm were used, respectively. The curve, obtained when toner having an average particle diameter of 10 μm was used, is not shown, but was almost the same as that obtained when the toner of the average particle diameter of 11 μm was used. As can be understood from the curves, the smaller the toner particle is, the more faithfully the original can be copied. The image was improved in gradation when the toner of the average particle diameter of 9 μm or less was used.

Then, the inventors measured the resolution of the image developed on the photo-sensitive drum before transferred onto a paper sheet, and also the image transferred onto the sheet before being fixed by a fuser. The resolutions of the images, obtained when toners of various particle diameters were used, were measured against a predetermined resolution chart, by the use of a magnifying lens. The measurement results are shown in table 1.

Further, the transfer efficiencies of those portions of the respective images which had a density in the vicinity of 0.8 were measured. The measurement results are also shown in table 1.

As is shown in table 1, the smaller the toner particles, the higher the resolution of the image developed on the drum.

However, the smaller the toner particles, the lower the resolution of the image transferred onto the sheet. This is because the smaller the toner particles, the more greatly the toner scatters, and further, the lower the transfer efficiency. The fact that the transfer efficiency lowers as the toner particle diameter is small will be most clearly understood by comparing the transfer efficiencies of a solid portion of an image, obtained by using toners of various particle diameters.

As is described above, although the quality of the developed image can be enhanced by using toner of a small particle diameter, the small particle toner causes the image, transferred by the corona transfer method, to be greatly degraded.

SUMMARY OF THE INVENTION

It is the object of the invention to provide an image forming apparatus which can prevent the quality of the image from being degraded through the transfer process, even if toner of a small particle diameter is used.

To attain the above object, the image forming apparatus of the invention comprises means for forming a latent image on an image carrier; means for supplying a developer to the image carrier to form a developed image corresponding to the latent image on the image carrier, the developer including a toner having an average particle diameter falling within a range of about 3–10 μm, preferably within a range of 4–7 μm, and more preferably having a fluidity of 3 grams or less, means for transferring the developed image onto a recording medium by pressing the recording medium on the developed image.

The fluidity of the developer is measured by a method, hereinafter referred to.

According to the invention, since the medium is pressed by the transferring means against the image of high quality formed on the image carrier by toner of a small particle diameter, the image can be almost fully transferred, with little scattering of toner and little residual toner on the carrier.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

This invention will now be explained in detail with reference to FIGS. 1-6 showing an embodiment thereof.

Figure 2:
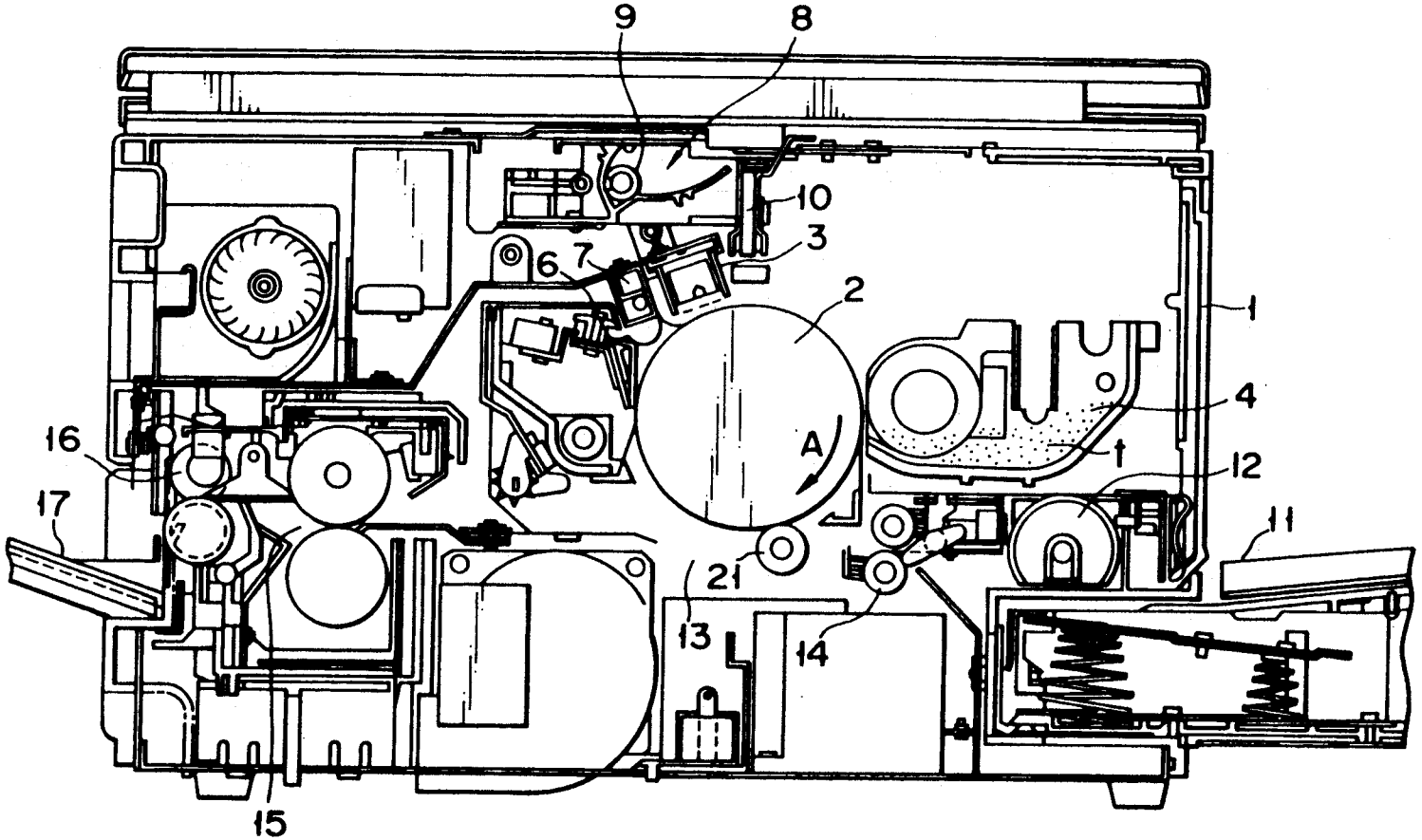
FIG. 2 is a longitudinal sectional view of the image forming apparatus or electronic copying machine.

FIG. 2 shows an electronic copying machine, in which numeral 1 designates a housing, and 2 a photo-sensitive drum (image-carrier) located in the substantially central portion of the housing 1, and rotatable in the direction indicated by the arrow A.

A charger 3, an image-developing unit 4, an image-transferring roller (image-transferring means) 21, a cleaning unit 6 and a discharger 7 are arranged, in the order mentioned, around the drum 2 in the direction of rotation.

Exposure means (electrostatic latent image-forming means) 8, comprising an exposure lamp 9 and a light-focusing element 10, is provided in an upper portion of the housing 1. A paper-supply cassette 11 is removably mounted on the housing 1 at a lower end and on one side thereof, for stocking sheets of paper P onto which images are transferred. The paper sheets P are taken out of the cassette 11 by a take-out roller 12, and transferred along a transfer pass 13.

A resist roller 14, an image-transfer roller 21, an image-fixing roller 15 and an exhaust roller 16 are provided, in the order mentioned, along the transfer pass 13 in the direction of transfer.

A paper-exhaust tray 17 is provided on the housing 1 at a lower end and on the other side thereof.

To form images, the charger 3 uniformly charges, for example, +750 V on the photo-sensitive drum 2. Then, the exposure means 8 forms an electrostatic latent image on the charged periphery of the drum 2. This electrostatic latent image is developed by the two-component developing unit 4 using a toner of negative polarity as a developer. The toner image is moved to an image-transferring region in accordance with the rotation of the drum 2 in the direction indicated by the arrow A. Each of the paper sheets P stocked in the supply cassette 11 is supplied to the image-transferring region by an aligning roller 14 at a suitable time while the charging, exposing and developing are executed. In the region, the paper sheet P has its reverse side pushed by the image-transferring roller 21, and its front side pressed against the toner image, whereby the toner image is transferred onto the paper sheet P. The sheet is then moved to the fixing unit 15 to make the image fixed thereon, and finally exhausted. On the other hand, the residual toner is removed from the photo-sensitive drum 2 by the cleaning unit 6. Thereafter, the static electricity on the drum 2 is eliminated by the discharging lamp 7, which is the termination of one cycle of the copy process.

Figure 1:
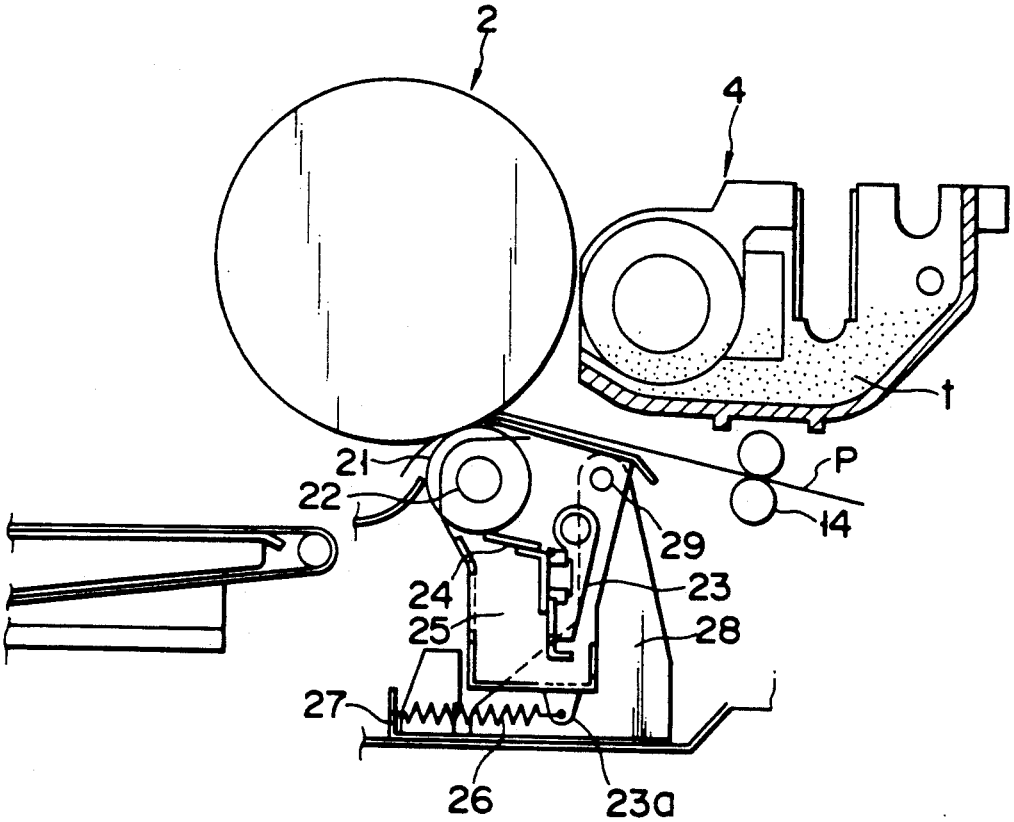
FIG. 1 is a fragmentary sectional view of an image forming apparatus of the invention, useful in explaining the transfer of an image by an image-transferring roller incorporated in the apparatus

Now, the image-transferring means will be explained more in detail with reference to FIG. 1. The paper sheet P is supplied by the aligning roller 14 between the drum 2 and the image-transferring roller 21. The roller 21 has a shaft 22 to which a bias of positive polarity is applied. Thus, the toner image formed on the photo-sensitive drum 2 is transferred onto the paper sheet P. The roller 21 also serves as a sheet-transporting member, which enhances the pressing of the sheet P against the surface of the drum 2, and hence minimizes undesirable movement of the sheet P. The roller 21 is supported by a roller-supporting member 23 to which a roller-cleaning blade 24 and a toner-receiving box 25 are secured. The pressure of the roller 21 is given by a spring 26 provided between the lower end portion 23*a* of the roller-supporting member 23 and a spring-supporting member 27. The roller-supporting member 23 is rotatably secured to a roller unit frame 28 by way of a fulcrum 29.

In this embodiment, the image-transferring roller 21 has no driving means, but can rotate in accordance with the rotation of the drum 2. Further, the roller 21 is supplied with voltage by voltage-applying means 40. To perform a good transfer of image, the bias must fall within a range of 1200-2200 V. The bias lower than 1200 V does not perform a good transfer, while the bias higher than 2000 V causes the leakage of current. In the process using reversal development, the bias should be set lower. In addition, the pressure of the roller 21 against the drum 2 and the hardness of the roller 21 are also important factors for performing a good transfer of image. The appropriate pressure is 60 g/cm$^2$-280 g/cm$^2$ (these values are obtained by dividing all pressure by the nip area of roller 21). The preferable hardness of the roller rubber is 10-60 (JIS A). The nip width is about 0.4-3 mm.

The condition of the roller 21 employed in the embodiment is:

Bias 1800 V

Urging Force: 100 g/cm$^2$

Hardness: 30 (JIS A)

The resolution of the images formed on the sheet P and on the drum 2 by the apparatus satisfying the above condition and using the corona transfer method, and the transfer efficiency of solid portions of the image formed on the sheet P were measured. The measurement results are listed in the attached table 2. As can be understood from the table 2, the roller 21 prevents the resolution and transfer efficiency from being greatly deteriorated owing to scattering of toner, if the toner of a particle diameter of 10 μm or less is used.

In the measurements, toner having a particle diameter of 2.5 μm caused blank portions in characters and lines. In particular, considerably many portions of a line having a width of 200-500 μm were blank.

Figure 3:
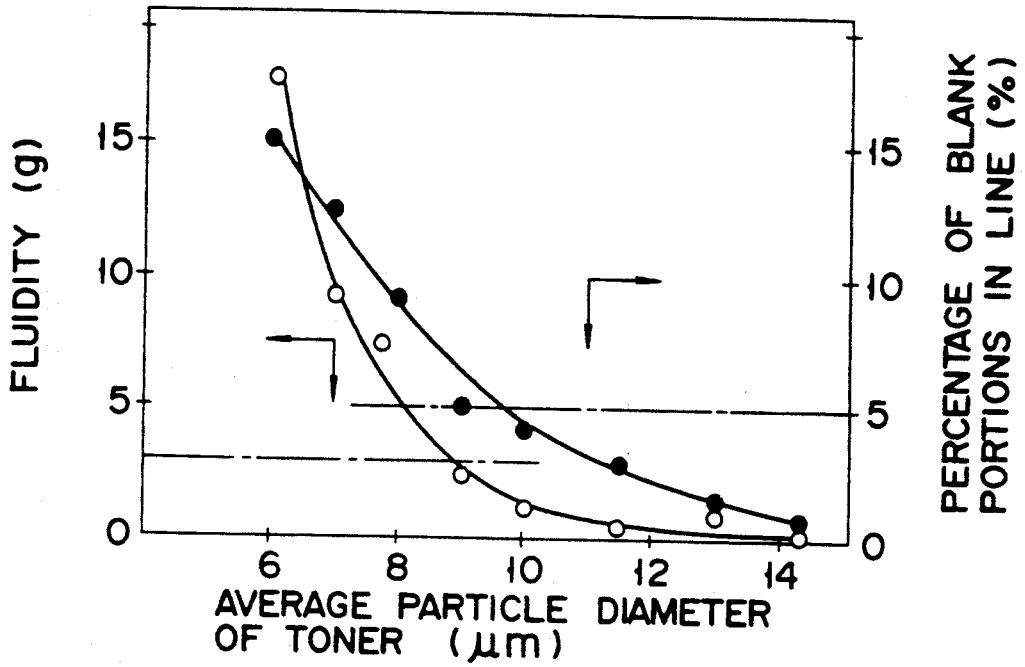
FIG. 3 is a graph showing the relationship between the particle diameter of toner, the fluidity of the toner, and the percentage of blank portions in a line.

FIG. 3 shows a variation in the fluidity of toner according to a variation in particle diameter thereof. It is understood from the figure that the smaller the diameter is, the lower the fluidity is, and that the lower the fluidity is, the more portions of the line will be blank. If the blank portions exceed 5%, the line formed will appear discontinuous to the naked eye.

Figure 4:
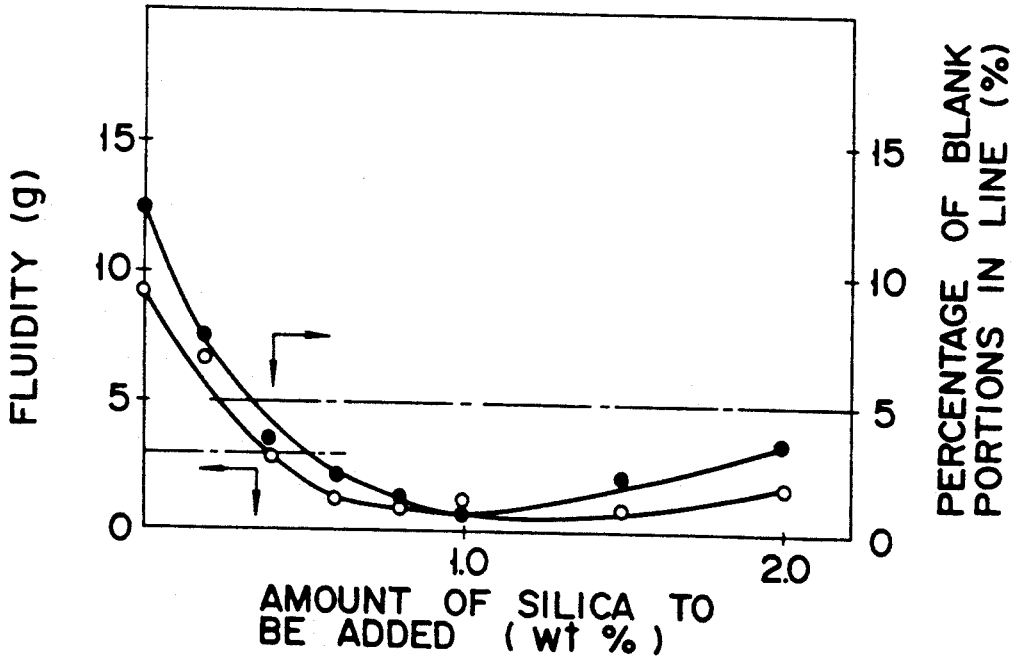
FIG. 4 is a graph showing the relationship between the amount of silica to be added, the fluidity of toner, and the percentage of blank portions in a line.
Figure 5:
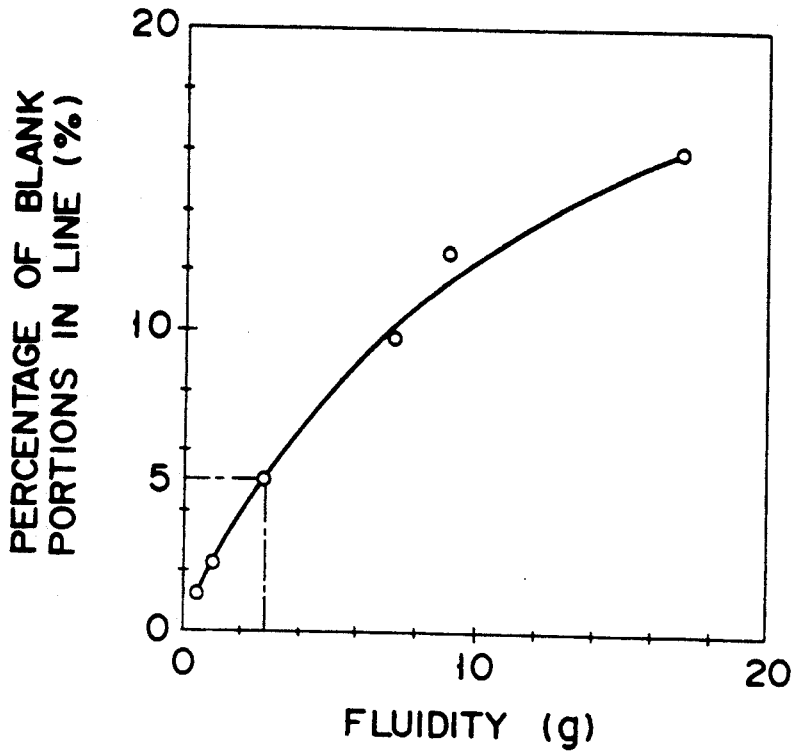
FIG. 5 is a graph showing the relationship between the fluidity of toner and the percentage of blank portions in a line.

As is shown in FIG. 5, if the fluidity of toner having a particle diameter of 9 μm or less exceeds 3 grams (the fluidity will be defined hereinafter), more than 5% of the line will be blank (the graph shows the case of a line having a width of 300 μm). In the experiments, although the transfer efficiency of solid portions and sharpness of characters were enhanced by transferring image with the use of the image-transferring roller and toner of a small particle diameter, blank portions appeared in lines or characters. Therefore, to enhance the fluidity of toner, silica (R 972 made by Aerogil Corporation) was mixed into the toner of a particle diameter of 7 μm. FIG. 4 shows variations in the fluidity of the toner and in the blank formed in a line having a width of 300 μm, having been obtained when the amount of silica was varied from 0.2 wt % of the total amount of the developer to 2.0 wt %. When the amount of silica mixed was 0.4 wt % or more, the fluidity of the toner was 3 (g) or less, and the blank portions were 5% or less of the line, which was not discernible as a defective line to the naked eye. In this way, high-quality images of the line were obtained.

The measurement results indicate that toner, having a particle diameter of 3–10 μm, preferably 4–7 μm, and having a fluidity of 3 (g) or less, can produce images of lines or characters in good gradation and without causing blank portions or scattering the toner.

Although silica is added in the embodiment to enhance the fluidity of toner, fine particles of $TiO_2$, alumina or an additive resin can be used in place of silica.

Then, methods of measuring the fluidity of toner and the blank formed in lines and characters will be explained.

Measurement of the Fluidity of Toner

A powder tester (made by Hosokawa Co., Ltd.) is used.

1) Putting toner into a polyethylene bottle, and shaking it twenty times by the hand;

2) Placing on the tester a screen having 200 openings, a screen having 100 openings and a screen having 60 openings one on another in the order mentioned;

3) Placing 20 g of the toner on the top screen having 60 openings;

4) Setting the mode of the tester to vibration mode, and making it vibrate for 30 seconds; and 5) Summing up the amounts of the residual toner on the screens of 60 openings and 100 openings.

The fluidity is expressed in terms of the sum (g) thus obtained.

Measurement of the Blank formed in Lines and Characters

TOSPIX-II (made by Kabushiki Kaisha Toshiba) is used as an image processing apparatus, stereomicroscope SMZ-10 (made by Nippon Kogaku K. K.) and ITV Camera CTC-2600 (made by Ikegami Tsushinki Co., Ltd.) as input apparatuses, and LA-150SAE (made by Watch Works Corporation) as a lighting apparatus. A line having a width of 300 μm is measured by the objective at 2 power.

1) Inputting the image of the line into the TOSPIX-II;

2) Converting the image information to binary digits, with the threshold set near a density of 0.5;

3) Measuring the area S2 of blank portions in the image;

4) Measuring the total area S1 of the image including the area S2; and

5) Obtaining the percentage of the blank portions from $S2/S1 \times 100$ (%).

Figure 6:
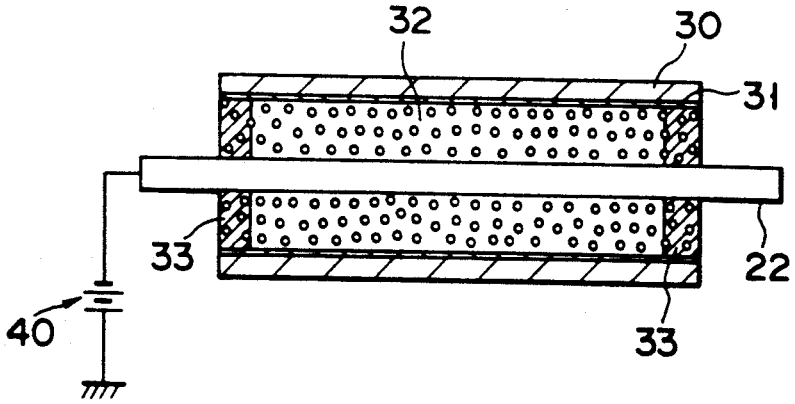
FIG. 6 is a longitudinal sectional view of the image-transferring roller shown in FIG. 1.
Figure 7:
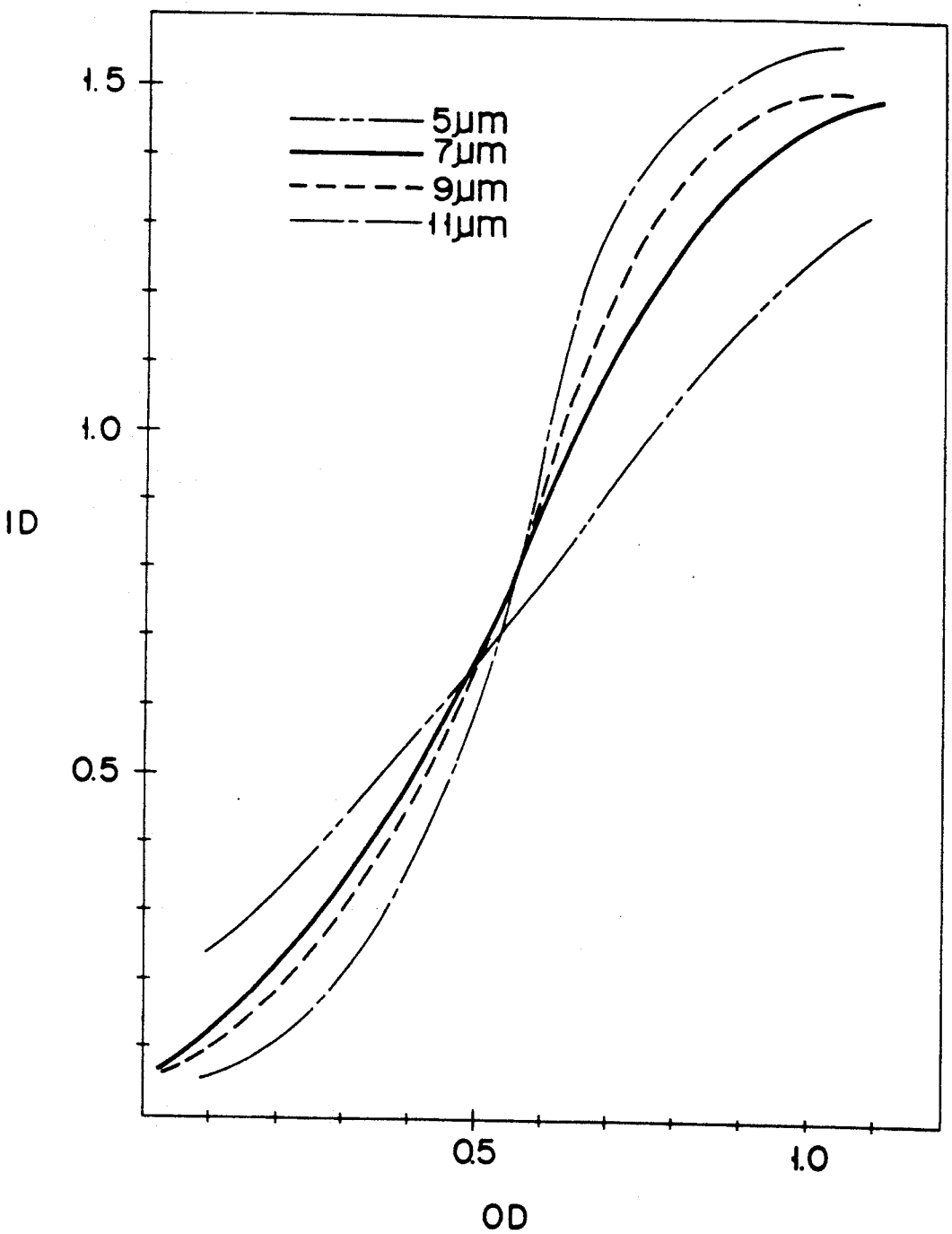
FIG. 7 is a graph showing gamma curves described by toners of various particle diameters.

FIG. 6 shows the structure of the image-transferring roller 21. Numeral 30 designates a resistive layer, 31 an electric conductive layer, 32 an elastic layer, and 22 a metal shaft. The resistive layer is composed by dispersing conductive metal particles of, for example, conductive carbon, copper or nickel in a rubber member or a resin member composed of, for example, polyester, polyethylene, or chloroethylene. Alternatively, the resistive layer is formed by a flexible resist sheet composed of, for example, a conductive high polymer resin. The volume resistivity of the layer 30 should fall within a range of $10^3$–$10^{25}$ Ω cm, preferably $10^6$–$10^{23}$ Ω cm, as will be explained hereinafter. The volume resistivity can be easily adjusted by varying the content of the conductive particles in the, resin or rubber. Further, it is desireable that the change in the volume resistivity be as little as possible despite by the pressure applied thereto from the outside and/or other circumferential conditions such as the room temperature and humidity. The resin-sheet structure has no spaces therein for containing air, and hence its resistivity is less affected by humidity than that of the foam structure. If the above desirable conditions are satisfied, the toner images can be transferred well, even when image-bearing media having different thicknesses such as an envelope and a post card are held one after another between the photosensitive drum (toner image carrier) 2 and the image-transferring roller 21, which members 2 and 21 are in tight contact with each other, or even when the room temperature and humidity are changed. It is also desirable if the resistive layer 30 has a flat surface. The more flat the surface is, the more easily the toner stuck to the roller 21 can be removed to thereby prevent the reverse side of the paper sheet P from being stained by the toner. The resistive layer 30 should be as thin as possible, and preferably has a thickness falling within a range of 0.02–2 mm, so as to keep the flexibility of the elastic layer 32. The conductive layer 31 needs conductivity and flexibility, and can be formed by a conductive resin member composed of, for example, polyester containing conductive carbon particles therein, or by a thin metal sheet or a conductive adhesive. The volume resistivity of the layer 31 should be lower than that of the layer 30, i.e. $10^5$ Ω cm or less. The layers 30 and 31 should be electrically connected to each other. The conductive layer 31 had better be also as thin as possible to keep the flexibility of the elastic layer 32. The sum of the thicknesses of the layers 30 and 31 should be one tenth of the thickness of the layer 32 to keep the flexibility thereof. The layer 32 can be formed by a compression-deformable elastic member, composed of forming rubber sponge, foaming polyethylene, urethane or the like. Since the image is transferred roller 21 against the toner image carrier 2, the elastic layer 32 of the roller 21 should be deformed with ease when it is pressed, and restored upon being brought out of contact with the carrier 2, and also should bear the repeat of the action. Thus, a material is desirable which has high resistance to creep and plastic deformation. Although either an open cell foam structure or a closed cell foam structure is used as a foam structure, the former is preferable since the configuration thereof is stable irrespective of the atmospheric temperature. The flexibility of the elastic layer 32 can be controlled by changing the composition, foam structure and/or foaming degree. The desirable hardness is equal to or lower than the hardness 30 (JIS A) of the sponge rubber having the closed cell foam structure.

The conductive layer 31 is connected to the shaft 22 by way of conductive members 33 provided in the both opposite end portions of the roller 21.

As is described above, a high quality image can be obtained by the use of the image-transferring roller 21 constructed as above and toner having a particle diameter of 10 μm.

Though the embodiment employs the two-component development, the present invention can be applied to other electrophotography such as monocomponent development. Further, though the roller 21 comprises the elastic layer and resistive layer in the embodiment, it can be modified such that the elastic layer also serves as a resistive layer, and therefore, no resistive layers are provided. The present invention can be applied to other image-transferring means such as an endless belt.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

TABLE 1

| DIAMETER OF TONER | TRANSFER METHOD | MEASUREMENT OF RESOLUTION ON DRUM CIRCUM-FERENTIAL | ON DRUM LONGITUDIAL | ON MEDIUM CIRCUM-FERENTIAL | ON MEDIUM LONGITUDIAL | TRANSFER EFFICIENCY (ID0.8) |
|---|---|---|---|---|---|---|
| 11 μm | CORONA TRANSFER | 7 l p/mm | 6 l p/mm | 6.5 l p/mm | 5.5 l p/mm | 88% |
| 9 μm | CORONA TRANSFER | 8 l p/mm | 7 l p/mm | 7 l p/mm | 6.0 l p/mm | 80% |
| 7 μm | CORONA TRANSFER | 9 l p/mm | 8.5 l p/mm | 7.5 l p/mm | 7 l p/mm | 74% |
| 5 μm | CORONA TRANSFER | 9 l p/mm | 9 L p/mm | 7.6 l p/mm | 7.6 l p/mm | 65% |

TABLE 2

| DIAMETER OF TONER | TRANSFER METHOD | MEASUREMENT OF RESOLUTION ON DRUM CIRCUM-FERENTIAL | ON DRUM LONGITUDIAL | ON MEDIUM CIRCUM-FERENTIAL | ON MEDIUM LONGITUDIAL | TRANSFER EFFICIENCY (ID0.8) |
|---|---|---|---|---|---|---|
| 11 μm | ROLLER TRANSFER | 7 l p/mm | 6 l p/mm | 6.5 l p/mm | 6.0 l p/mm | 88% |
| 10 μm | ROLLER TRANSFER | 7.5 l p/mm | 7 l p/mm | 7 l p/mm | 7 l p/mm | 88% |
| 7 μm | ROLLER TRANSFER | 9 l p/mm | 8.5 l p/mm | 8.5 l p/mm | 7.5 l p/mm | 86% |
| 5 μm | ROLLER TRANSFER | 9 l p/mm | 9 l p/mm | 8.5 l p/mm | 8.5 l p/mm | 76% |
| 4 μm | ROLLER TRANSFER | 9.5 l p/mm | 9 l p/mm | 8.5 l p/mm | 8.5 l p/mm | 71% |
| 3 μm | ROLLER TRANSFER | 9.5 l p/mm | 9 l p/mm | 8 l p/mm | 8 l p/mm | 70% |
| 2.5 μm | ROLLER TRANSFER | 8.5 l p/mm | 8.5 l p/mm | 6.5 l p/mm | 6 l p/mm | 55% |

What is claimed is:

1. An image forming apparatus comprising:

means for forming a latent image on an image carrier;

means for supplying a developer to the image carrier to form a developed image corresponding to the latent image on the image carrier, the developer including a toner having an average particle diameter falling within a range of about 3–10 μm, the toner having a fluidity of not more than 3 grams, the developer containing 0.3–2.0 weight % of a flow additive; and means for transferring the developed image onto a recording medium by pressing the recording medium on the developed image; the transferring means including an elastic layer; and a pressure per a nip area between the transferring means and the image carrier being within a range of 60 g/cm$^2$–280 g/cm$^2$.

2. The apparatus according to claim 1, wherein the image-transferring means comprises:

roller means for transporting the medium;

means for pressing the roller means against the image carrier;

means for rotatably supporting the roller means; and means for applying voltage to the roller means.

3. The apparatus according to claim 2, wherein the roller means comprises:

a shaft;

a conductive and elastic layer covering the shaft; and a resistive layer covering the conductive and elastic layer.

4. The apparatus according to claim 1, wherein the developer includes a toner having an average particle diameter falling within a range of 4–7 μm.

5. An image forming apparatus comprising:

means for forming a latent image on an image carrier;

mean for supplying a developer to the image carrier to form a developed image corresponding to the latent image on the image carrier, the developer including a toner having an average particle diameter falling within a range of about 3–10 μm, the toner having a fluidity of not more than 3 grams, the developer containing 0.3–2.0 weight % of a flow additive; and means for transferring the developed image onto a recording medium by pressing the recording medium on the developed image; wherein the transferring means includes roller means for transporting the medium, means for pressing the roller means against the image carrier, means for rotatably supporting the roller means, and means for applying voltage to the roller means; wherein a pressure per a nip area between the transferring means and the image carrier is within a range of 60 g/cm$^2$–280 g/cm$^2$; and wherein the roller means comprises a shaft; an elastic layer covering the shaft; a conductive layer comprising a conductive member and covering the elastic layer; a resistive layer comprising a resistance member and covering the conductive layer; and a conductive member for electrically connecting the shaft to the conductive layer.

6. The apparatus according to claim 5, wherein the conductive layer is conductive and flexible, and has a volume resistivity lower than that of the resistive layer, the volume resistivity being equal to or lower than $10^5$ Ω cm.

7. The apparatus according to claim 5, wherein the developer includes a toner having an average particle diameter falling within a range of 4–7 μm.

8. An image forming apparatus comprising:

means for forming a latent image on an image carrier;

means for supplying a developer to the image carrier to form a developed image corresponding to the latent image on the image carrier, the developer including a toner having an average particle diameter falling within a range of about 3–10 μm, the developer containing 0.3–2.0 weight % of a flow additive; and means for transferring the developed image onto a recording medium by pressing the recording medium on the developed image, a pressure per a nip area between the transferring means and the image carrier being within a range of 60 g/cm$^2$–280 g/cm$^2$;

the transferring means including a roller means for transporting the medium, a means for pressing the roller means against the image carrier, means for rotatably supporting the roller means, and means for applying voltage to the roller means;

the roller means including a shaft, an elastic layer covering the shaft, a conductive layer comprising a conductive member and covering the elastic layer, a resistive layer comprising a resistance member and covering the conductive layer, the conductive member electrically connecting the shaft to the conductive layer;

the resistive layer comprising non-conductive material and conductive fine particles dispersed in the non-conductive material, and having a volume resistivity falling within a range of $10^3$–$10^{25}$ Ω cm, and a thickness falling within a range of 0.02–2 mm.

9. The apparatus according to claim 8, wherein the conductive layer is conductive and flexible, and has a volume resistivity lower than that of the resistive layer, the volume resistivity being equal to or lower than $10^5$ Ω cm.

10. An image forming apparatus comprising:

means for forming a latent image on an image carrier;

means for supplying a developer to the image carrier to form a developed image corresponding to the latent image on the image carrier, the developer including a toner having an average particle diameter falling within a range of about 3–10 μm, the developer containing 0.3–2.0 weight % of a flow additive; and means for transferring the developed image onto a recording medium by pressing the recording medium on the developed image, a pressure per a nip area between the transferring means and the image carrier being within a range of 60 g/cm$^2$–280 g/cm$^2$;

the transferring means including a roller means for transporting the medium, a means for pressing the roller means against the image carrier, means for rotatably supporting the roller means, and means for applying voltage to the roller means;

the roller means including a shaft, an elastic layer covering the shaft, a conductive layer comprising a conductive member and covering the elastic layer, a resistive layer comprising a resistance member and covering the conductive layer, the conductive member electrically connecting the shaft to the conductive layer;

the resistive layer comprising a flexible and conductive member made of a high polymer resin, and having a volume resistivity falling within a range of $10^3$–$10^{25}$ Ω cm, and a thickness falling within a range of 0.02–2 mm.

11. The apparatus according to claim 10, wherein the developer includes a toner having an average particle diameter falling within a range of 4–7 μm.

12. An image forming apparatus comprising:

means for forming a latent image on an image carrier;

means for supplying a developer to the image carrier to form a developed image corresponding to the latent image on the image carrier, the developer including a toner having an average particle diameter falling within a range of about 3–10 μm, and also having a fluidity of 3 grams or less, the developer containing 0.3–2.0 weight % of a flow additive; and means for transferring the developed image onto a recording medium by pressing the recording medium on the developed image;

the transferring means including an elastic layer and a resistive layer, the resistive layer having a volume resistivity falling within a range of $10^3$–$10^{25}$ Ω cm; and a pressure per a nip area between the transferring means and the image carrier being within a range of 60 g /cm$^2$–280 g/cm$^2$.

13. The apparatus according to claim 12, wherein the developer consists of 0.3–2.0 weight % of silica and a toner having an average particle diameter falling within a range of 3–10 μm.

14. The apparatus according to claim 12, wherein the developer comprises 0.3–2.0 weight % of silica and a toner having an average particle diameter falling within a range of 4–7 μm.

15. The apparatus according to claim 12, wherein the developer comprises a material selected from a group consisting of $TiO_2$, alumina, particle of a resin, and a mixture thereof, and a toner having an average particle diameter falling within a range of 3–10 μm.

* * * * *